US007065975B1

(12) United States Patent
Herndon et al.

(10) Patent No.: US 7,065,975 B1
(45) Date of Patent: Jun. 27, 2006

(54) ICE DISPENSER FOR REFRIGERATOR WITH BOTTOM MOUNT FREEZER

(75) Inventors: Steven G. Herndon, Amana, IA (US); Bill Koons, Amana, IA (US); Steven L. Devlin, Ames, IA (US); John A. Roberts, Huxley, IA (US); Anna M. Jones, Ames, IA (US)

(73) Assignees: Iowa State University Research Foundation, Inc., Ames, IA (US); Maytag Corporation, Newton, IA (US)

( * ) Notice: Subject to any disclaimer, the term of this patent is extended or adjusted under 35 U.S.C. 154(b) by 0 days.

(21) Appl. No.: 10/884,898

(22) Filed: Jul. 6, 2004

(51) Int. Cl.
*F25C 5/18* (2006.01)

(52) U.S. Cl. ..... 62/66; 62/344

(58) Field of Classification Search ..... 62/66, 62/344, 347

See application file for complete search history.

(56) References Cited

U.S. PATENT DOCUMENTS 3,252,293 A * 5/1966 Frei, Sr. ..... 62/135
3,276,224 A * 10/1966 Lunde ..... 62/344
3,433,030 A * 3/1969 Jacobs ..... 62/186
4,104,889 A * 8/1978 Hoenisch ..... 62/137
4,732,301 A * 3/1988 Tobias et al. ..... 222/203
5,090,208 A * 2/1992 Aono et al. ..... 62/347
6,167,711 B1 * 1/2001 Slattery et al. ..... 62/78
6,442,954 B1 * 9/2002 Shapiro et al. ..... 62/137
6,745,578 B1 * 6/2004 Collins et al. ..... 62/71
6,810,682 B1 * 11/2004 Schuchart et al. ..... 62/98

* cited by examiner

*Primary Examiner*—William E. Tapolcai
(74) *Attorney, Agent, or Firm*—McKee, Voorhees & Sease, P.L.C.

(57) ABSTRACT

An ice dispensing system is provided for a refrigerator having a bottom freezer. The system includes an ice maker in the freezer compartment and an ice bucket in the refrigerator compartment. A shuttle carries ice from the ice maker to the bucket through a tube extending upwardly through the dividing wall between the freezer and refrigerator compartments. The bucket includes an auger in communication with an ice dispensing opening in the refrigerator door for ice on demand by a user. The shuttle is raised and lowered by a motor-driven cable.

30 Claims, 4 Drawing Sheets

ICE DISPENSER FOR REFRIGERATOR WITH BOTTOM MOUNT FREEZER

GRANT REFERENCE

Work for this invention was funded in part by a grant from the United States Department of Commerce Grant Numbers 05-66-06552-01 and 05-66-06552-02. The Government may have certain rights in this invention.

BACKGROUND OF THE INVENTION

Refrigerators with a bottom freezer have become popular in recent years. For many years, the typical refrigerator included a top mounted freezer. Later, side by side refrigerator and freezer combinations became popular. Since the freezer is not accessed as often as the refrigerator, some people are preferring the new bottom mount freezers, which minimizes need to bend over to reach items in the lower freezer portion of the unit. However, ice dispensers which are commonly found on the freezer door on side by side refrigerators have not been provided on the bottom mount refrigerators due to the lower position of the freezer.

Therefore, a primary objective of the present invention is the provision of an ice dispenser in the door of a refrigerator having a bottom mount freezer.

Another objective of the present invention is the provision of an ice dispenser which carries ice cubes from a bottom mount freezer upwardly to an ice bucket in the refrigerator chamber.

Yet another objective of the present invention is the method of dispensing ice from the door of a refrigerator having a bottom mount freezer.

A further objective of the present invention is the provision of an ice dispenser for a refrigerator bottom mount freezer which is economical to manufacture, and durable and effective in use.

These and other objectives become apparent from the following description of the invention.

BRIEF SUMMARY OF THE INVENTION

The ice dispenser of the present invention is designed for use in a refrigerator having a lower freezer compartment and an upper refrigerator compartment, and doors to each compartment. The ice dispenser has an ice maker in the freezer compartment and an ice bucket in the refrigerator compartment. The ice bucket may be surrounded by insulated walls to maintain substantially the same temperature as the freezer compartment. An ice shuttle moves between the ice maker and the ice bucket to carry ice cubes upwardly from the freezer compartment. A motor-driven cable moves the shuttle between the ice maker and the ice bucket. An auger is provided in the ice bucket for dispensing the cubes on demand through an opening in the refrigerator compartment door. Time delay switches and limit switches provide control of the movement of the shuttle.

DETAILED DESCRIPTION OF THE PREFERRED EMBODIMENT

Figure 1:
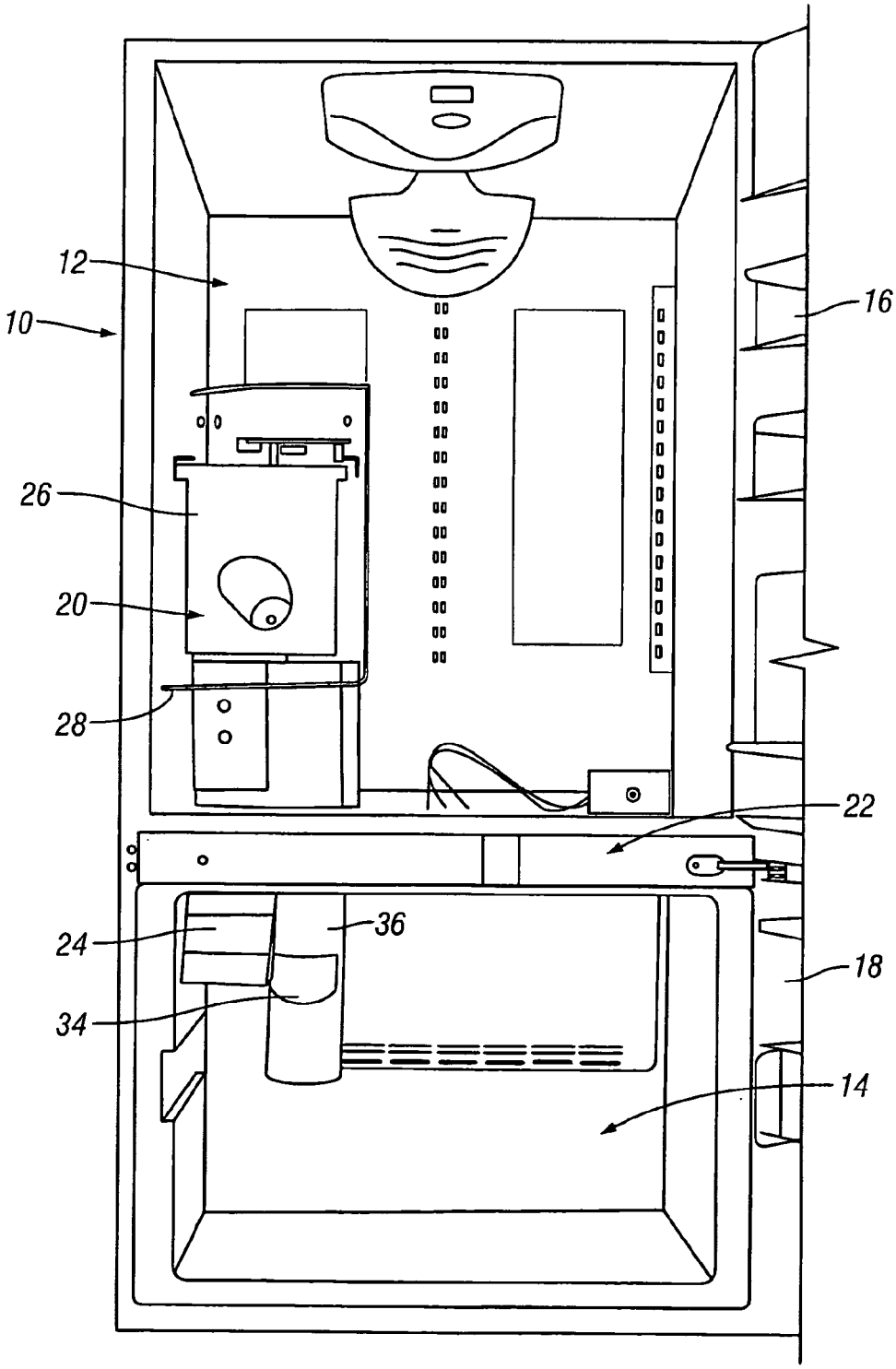
FIG. 1 is a front elevational view of a refrigerator with a bottom mount freezer showing the ice dispenser system of the present invention, with the lower chute removed for clarity.
Figure 2:
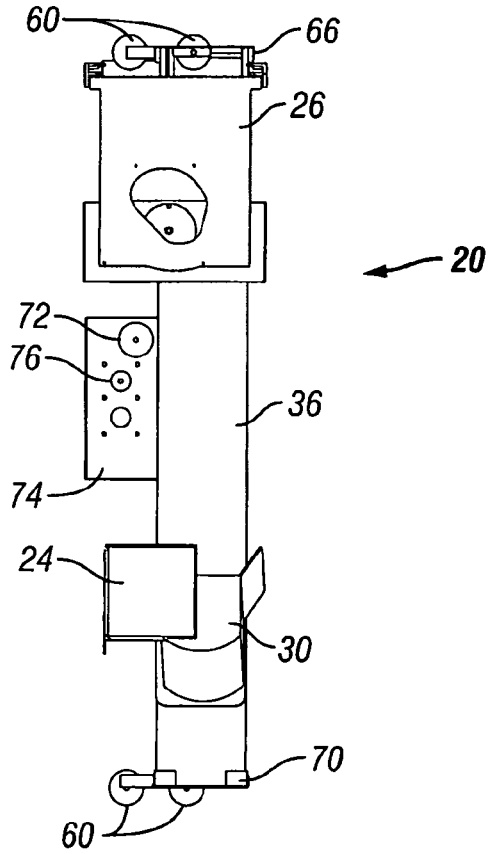
FIG. 2 is a front elevation view of the ice dispenser system of the present invention.

In the drawings, a refrigerator is designated by the reference numeral 10. The refrigerator 10 includes an upper refrigerator compartment 12 and a lower freezer compartment 14. This arrangement of the refrigerator and freezer compartments is commonly known as a bottom mount refrigerator. A refrigerator door 16 is provided for the refrigerator compartment 12, and a freezer door 18 is provided for the freezer compartment 16.

The present invention is directed towards an ice dispensing system 20 which extends through the horizontal wall 22 separating the upper refrigerator compartment 12 and the lower freezer compartment 14.

The ice dispensing system 20 includes an ice maker 24 in the freezer compartment 14. An ice bucket 26 resides within an insulated housing 28 in the refrigerator compartment 14. The internal temperature of the housing 28 is maintained at substantially the same temperature as freezer compartment 14.

Figure 3:
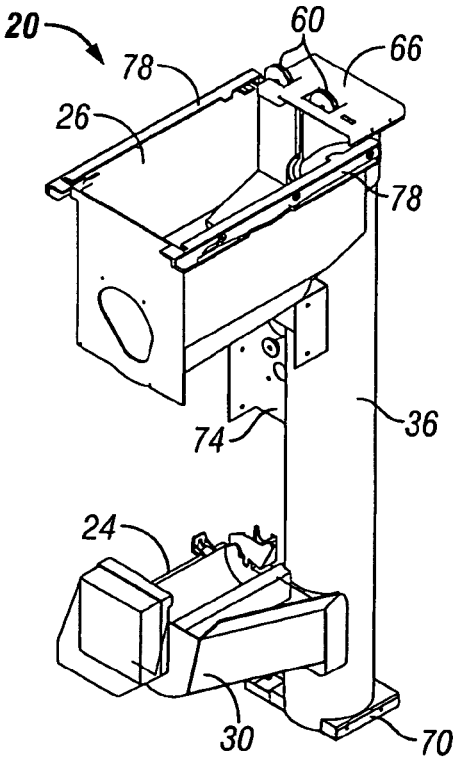
FIG. 3 is a perspective view of the ice dispenser system of the present invention.

The ice maker 24 is conventional in construction, and includes fingers to push the ice cubes into a chute 30. The chute 30 slopes downwardly, as seen in FIG. 3. The lower end 32 of the chute 30 is open and in communication with an opening or ice inlet 34 in a vertically oriented tube 36 which extends through the wall 22 into the refrigerator and freezer compartments 12, 14.

Figure 4:
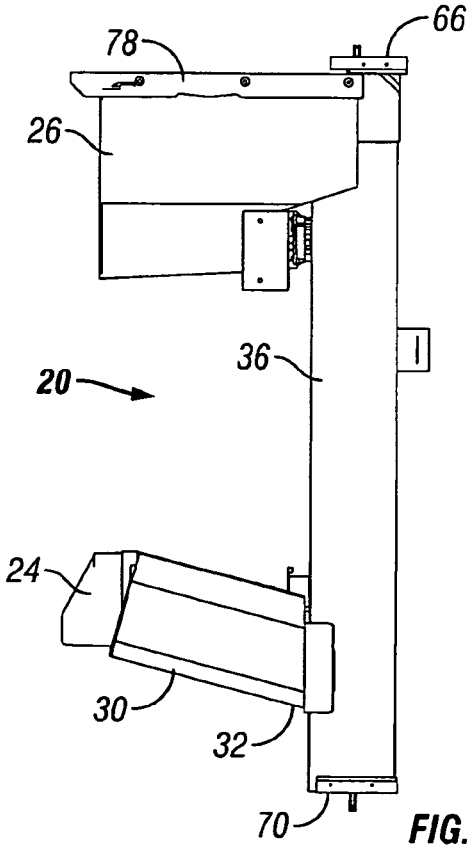
FIG. 4 is a side elevational view of the ice dispenser system.
Figure 5:
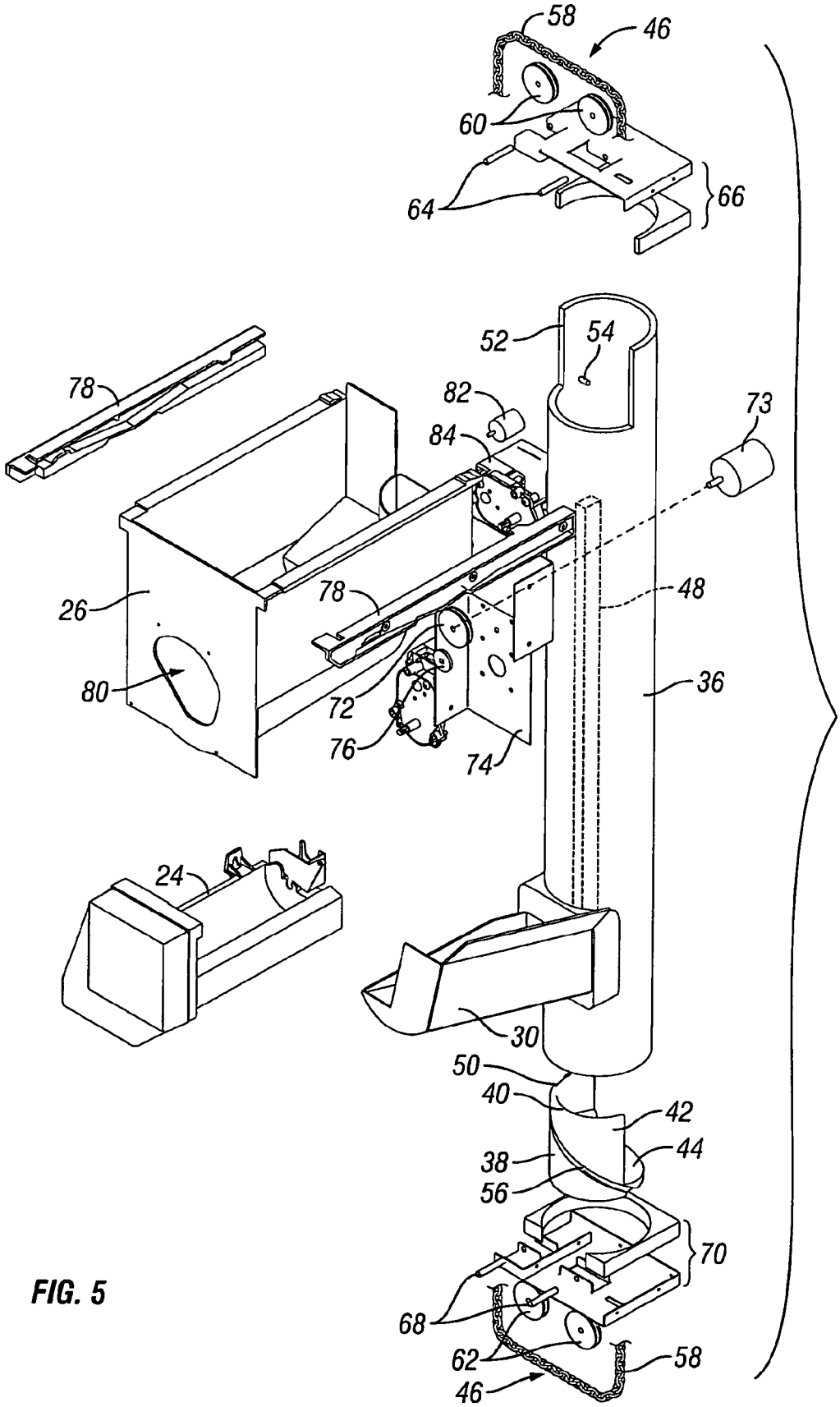
FIG. 5 is an exploded view of the components of the ice dispenser system.
Figure 6:
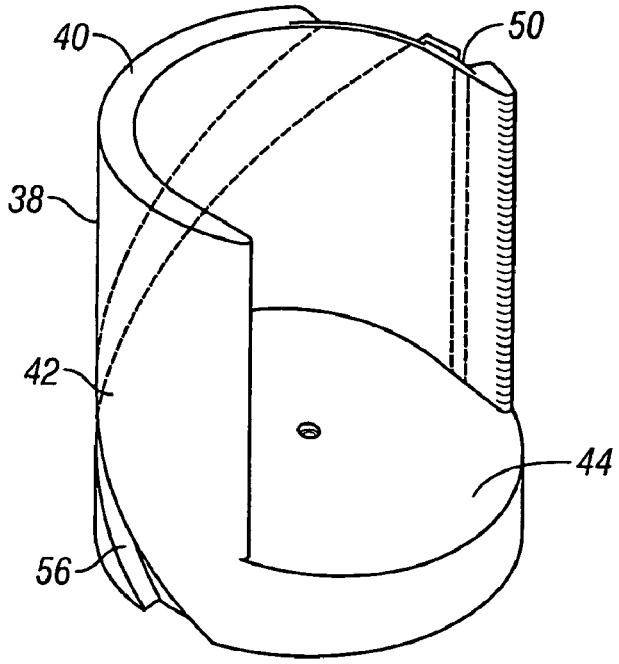
FIG. 6 is a perspective view of the ice shuttle used in the dispenser system.

An ice shuttle 38 is mounted within the tube 36 and is moveable along the height of the tube 36. When the shuttle 38 is in its lower-most position at the bottom of the tube 36, the upper edge 40 of the shuttle resides below the opening 32, such that ice cubes may fall into the cup-like shuttle 38. As seen in FIGS. 4 and 5, the shuttle 38 has a side wall 42 which extends approximately 180°–270°. The bottom wall 44 of the shuttle 38 is sloped downwardly away from the sidewall 42.

The shuttle 38 moves between lower and upper positions within the tube 36 by a cable system 46. In the lower-most position, the open side of the shuttle 38 opposite the side wall 42 faces away from the ice inlet 34 and the tube 36, as best seen in FIG. 4. A track 48 is provided on the inner wall of the tube 36 and receives a vertical groove or slot 50 in the side wall 42 of the shuttle 38. The track 48 maintains the open side of the shuttle 38 in a rearwardly directed position during travel along the substantial height of the tube 36. A series of pins or projections may be provided in the tube 36 as an alternative to the guide track 48. The upper end of the tube 36 includes a forwardly-facing opening or ice outlet 52, as best seen in FIG. 4. Adjacent the outlet 52 is a cam pin 54 which is received in a spiral or helix groove or slot 56 in the side wall 42 of the shuttle 38. As the shuttle 38 continues to move upwardly with the cam pin 48 received in the slot 56, the shuttle rotates 180° so that the open side of the shuttle 38 faces forwardly in alignment with the cutout 52 in the tube. With such alignment of the open side of the shuttle 38 and the tube cutout 52, ice cubes are free to slide by gravity down the sloping bottom wall 44 of the shuttle 38 and into the ice bucket 26.

Figure 7:
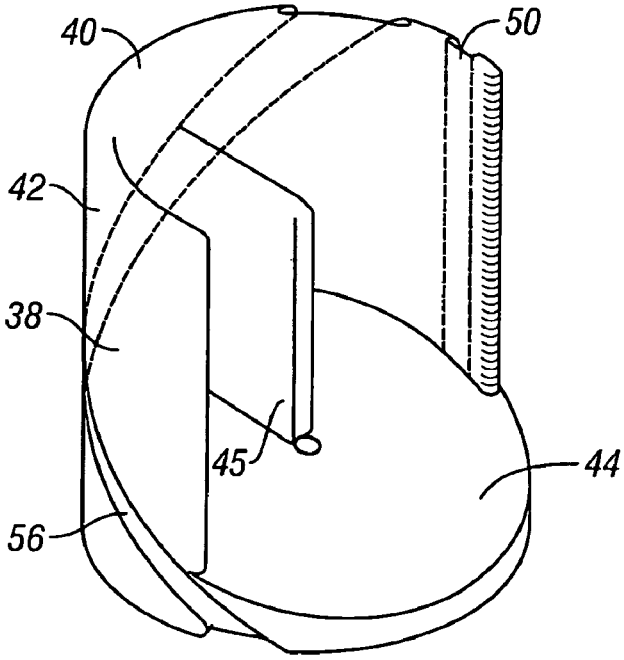
FIG. 7 is a perspective view of an alternative embodiment of the ice shuttle.

The cable drive system 46 of the shuttle 38 includes a continuous loop cable 58 trained about a pair of upper driver rollers 60 and a pair of lower driver rollers 62, and connected to the shuttle 38. The cable 58 connects to the center of the bottom 49 of the shuttle 38. In the alternative embodiment of the shuttle shown in FIG. 7, a radially extending wall 45 prevents ice from being retained behind the cable 58. The upper rollers 60 are mounted upon pins or shafts 64 which are supported on an upper bracket assembly 66 mounted on the top of the tube 36. The lower rollers 62 are mounted on pins or shafts 68 supported on a lower bracket assembly 70 mounted on the lower end of the tube 36. The cable 58 is driven by a driver roller 72 which is rotated in opposite directions by a reversible electric motor 73. The motor 73 is mounted on a support bracket or plate 74. An adjustable roller 76 is adjustably mounted on the plate 74 so that the tension in the cable 58 can be adjusted.

The ice bucket 26 is slideably mounted upon rails 78 which are mounted on the inside of the housing 28, such that the bucket is removeable from the refrigerator compartment 12. The forward end of the ice bucket 26 includes an opening 80 which aligns with a conventional ice dispenser (not shown) in the refrigerator door 16. A standard auger system is operatively mounted in the ice bucket 26 so as to convey ice on demand to the dispenser in the door 16. The auger is driven by a motor 82 mounted on a plate 84. The plates 74, 84 may be mounted in the refrigerator compartment 12 in any convenient manner. The auger motor 82, auger (not shown) and the dispenser in the refrigerator door 16 are conventional in construction.

In operation, the ice dispensing system 20 of the present invention carries ice from the ice maker 24 in the freezer compartment 14 upwardly to the ice bucket 26 in the refrigerator compartment 14 for dispensement through the dispenser in the refrigerator door 16. The ice maker 24 is electrically connected to the motor 73 such that each time ice cubes are ejected from the ice maker 24, the motor delays a predetermined time to allow the ice cubes to fall through the chute 30, through the chute inlet 34, and into the shuttle 38. The motor 73 is then actuated to drive the cable 58 and thereby raise the shuttle 38 from the bottom of the tube 36 to the top of the tube 36. After the cam pin 54 is received in the spiral groove 56 of the shuttle 38, continued upward movement of the shuttle 38 pivots or rotates the shuttle 38 so that the open side thereof is aligned with the outlet 52 in the top of the tube 36. The ice cubes fall by gravity into the ice bucket 26 from the sloped floor 44 of the shuttle 38. As the shuttle 38 reaches the top of the tube 36, a limit switch (not shown) is engaged to temporarily deactivate the motor 73 to allow sufficient time to unload the ice cubes from shuttle 38 to the bucket 26. The motor 73 is then actuated in a reverse direction to lower the shuttle 38 to the bottom of the tube 36 for receipt of the next batch of ice cubes from the ice maker 24. A limit switch (not shown) at the bottom of the tube deactivates the motor 73.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An ice dispensing system for a refrigerator having a lower freezer compartment, an upper refrigerator compartment, and doors for each compartment, the system comprising:

an ice maker in the freezer compartment;

an ice bucket in the refrigerator compartment; and a shuttle movable between the ice maker and the ice bucket for carrying ice cubes upwardly from the ice maker to the ice bucket.

2. The ice dispensing system of claim 1 further comprising a chute for directing ice cubes from the ice maker to the shuttle.

3. The ice dispensing system of claim 1 further comprising a tube having an ice inlet adjacent the ice maker and an ice outlet adjacent the ice bucket, and the shuttle residing within the tube.

4. The ice dispensing system of claim 3 wherein the shuttle has an exterior groove and the tube has a pin to guide movement of the shuttle.

5. The ice dispensing system of claim 4 wherein the groove is a spiral such that the shuttle turns adjacent the ice outlet of the tube.

6. The ice dispensing system of claim 3 wherein the shuttle has a sloped bottom so that ice discharges by gravity through the ice outlet of the tube and into the ice bucket.

7. The ice dispensing system of claim 3 wherein the tube has a guide track for guiding movement of the shuttle within the tube.

8. The ice dispensing system of claim 1 further comprising a cable connected to the shuttle and a motor connected to the cable to drive the cable and thereby move the shuttle between the ice maker and the ice bucket.

9. The ice dispensing system of claim 8 further comprising a timing switch operatively connected to the motor to control movement of the shuttle.

10. The ice dispensing system of claim 8 further comprising limit switches at each end of the tube and operatively connected to the motor to control movement of the shuttle.

11. The ice dispensing system of claim 1 wherein the ice bucket is removable from the refrigerator compartment.

12. The ice dispensing system of claim 1 wherein the ice bucket has an auger for discharging ice through a dispenser in the door of the refrigerator compartment.

13. A refrigerator, comprising:

an upper refrigerator compartment;

a lower freezer compartment;

a door for the refrigerator compartment;

a door for the freezer compartment;

an ice maker in the freezer compartment;

an ice dispenser in the refrigerator compartment; and a shuttle for carrying ice cubes from the ice maker to the ice dispenser.

14. The refrigerator of claim 13 wherein the ice dispenser includes an outlet in the door of the refrigerator, a bucket for storing ice cubes and an auger for discharging ice cubes from the bucket.

15. The refrigerator of claim 13 further comprising a tube extending between the ice maker and the ice dispenser, the shuttle being movably mounted in the tube.

16. The refrigerator of claim 15 wherein the tube has an ice inlet adjacent the ice maker and an ice outlet adjacent the ice dispenser.

17. The refrigerator of claim 15 wherein the tube has a projection and the shuttle has a groove to receive the projection and thereby guide movement of the shuttle along the track.

18. The refrigerator of claim 17 wherein the groove spirals around the shuttle whereby the shuttle rotates in the tube adjacent the ice dispenser.

19. The refrigerator of claim 13 wherein the shuttle has an inclined bottom such that ice cubes slide by gravity from the shuttle into the ice dispenser.

20. The refrigerator of claim 13 further comprising a lifting mechanism for raising and lowering the shuttle between the ice maker and the ice dispenser.

21. The refrigerator of claim 20 wherein the lifting mechanism is a cable drivingly connected to a motor and to the shuttle.

22. The refrigerator of claim 20 wherein the lifting mechanism includes switches for controlling movement of the shuttle.

23. A method of dispensing ice from a refrigerator, comprising:

making batches of ice in a lower freezer compartment of the refrigerator;

carrying each batch of ice upwardly in a shuttle from the lower freezer compartment to an upper refrigerator compartment;

storing the batches of ice in a bucket in the upper refrigerator compartment; and dispensing ice on demand from the bucket through an outlet in a door of the upper refrigerator compartment.

24. The method of claim 23 further comprising automatically moving the shuttle between the lower freezer compartment and the upper refrigerator compartment.

25. The method of claim 23 further comprising controlling movement of the shuttle between the freezer and refrigerator compartments using switches.

26. The method of claim 23 further comprising a motor to lift the shuttle after each batch of ice is made in the freezer compartment.

27. The method of claim 23 further comprising guiding the movement of the shuttle between the freezer and the refrigerator compartments.

28. The method of claim 27 further comprising rotating the shuttle adjacent the ice dispenser to allow gravity discharge of ice from the shuttle into the ice dispenser.

29. The method of claim 13 further comprising loading the shuttle with each batch of ice by gravity.

30. The method of claim 13 further comprising unloading ice from the shuttle by gravity.

* * * * *